US006840015B1

(12) United States Patent
Ashley

(10) Patent No.: US 6,840,015 B1
(45) Date of Patent: Jan. 11, 2005

(54) ROOFTOP FALL ARRESTER WITH WORKING PLATFORM

(76) Inventor: Steven M. Ashley, 2000 Axtel-Anceny Rd., Bozeman, MT (US) 59718

( * ) Notice: Subject to any disclaimer, the term of this patent is extended or adjusted under 35 U.S.C. 154(b) by 74 days.

(21) Appl. No.: 10/139,156

(22) Filed: May 3, 2002

Related U.S. Application Data

(60) Provisional application No. 60/288,954, filed on May 4, 2001.

(51) Int. Cl.[7] ..... E04B 7/00

(52) U.S. Cl. ..... 52/90.1; 52/127.1; 52/127.2; 52/DIG. 12; 182/82; 182/45; 182/113

(58) Field of Search ..... 52/90.1, 127.1, 52/127.2, DIG. 12; 182/82, 45, 113, 150; 256/DIG. 6; 248/237

(56) References Cited

U.S. PATENT DOCUMENTS

| | | | | | |
|---|---|---|---|---|---|
| 2,329,415 | A | * | 9/1943 | Osborne | 248/237 |
| 4,078,633 | A | * | 3/1978 | Fahy | 182/82 |
| 4,616,734 | A | | 10/1986 | Phelps | |
| 4,726,589 | A | * | 2/1988 | Grigas | 473/169 |
| 4,957,185 | A | * | 9/1990 | Courchesne et al. | 182/150 |
| 5,143,187 | A | * | 9/1992 | McQuarrie et al. | 188/376 |
| 5,220,977 | A | * | 6/1993 | Wolner | 182/18 |
| 5,251,415 | A | * | 10/1993 | Van Auken et al. | 52/407.4 |
| 5,314,167 | A | | 5/1994 | Hollman | |
| 5,406,764 | A | * | 4/1995 | Van Auken et al. | 52/408 |
| 5,515,941 | A | * | 5/1996 | Palmer et al. | 182/45 |
| 5,524,875 | A | * | 6/1996 | Thommen, Jr. | 256/12.5 |
| 5,558,312 | A | * | 9/1996 | Brennan | 256/67 |
| 5,570,559 | A | | 11/1996 | Lewis | |
| 5,573,227 | A | | 11/1996 | Hermauer | |
| 5,638,917 | A | | 6/1997 | Vennen | |
| 5,676,350 | A | * | 10/1997 | Galli et al. | 256/13.1 |
| 5,718,305 | A | * | 2/1998 | Palmer | 182/45 |
| 5,778,628 | A | * | 7/1998 | Pendley | 52/749.12 |
| 5,878,838 | A | * | 3/1999 | Lapp | 182/150 |
| 6,038,829 | A | | 3/2000 | Franks | |
| 6,053,281 | A | * | 4/2000 | Murray | 182/113 |
| 6,167,986 | B1 | * | 1/2001 | Calvillo | 182/45 |
| 6,226,945 | B1 | * | 5/2001 | Henry et al. | 52/408 |
| 6,321,872 | B1 | * | 11/2001 | Parker | 182/3 |
| 6,336,623 | B1 | | 1/2002 | McCarthy | |
| 6,345,689 | B1 | * | 2/2002 | McNamee | 182/45 |
| 6,401,426 | B1 | * | 6/2002 | Alderman et al. | 52/749.12 |
| 6,422,339 | B1 | * | 7/2002 | Wisler | 182/82 |
| 6,446,752 | B2 | * | 9/2002 | Philippe | 182/82 |
| 6,585,080 | B2 | * | 7/2003 | Murray | 182/45 |
| 6,604,328 | B1 | * | 8/2003 | Paddock | 52/93.1 |
| 2002/0139614 | A1 | * | 10/2002 | Volkman | 182/82 |

FOREIGN PATENT DOCUMENTS

| | | | |
|---|---|---|---|
| CH | 677255 A5 | * | 4/1991 |
| DE | 33 09 577 A1 | * | 9/1984 |
| DE | 39 25 518 A1 | * | 2/1991 |
| FR | 2 566 820 | * | 1/1986 |
| GB | 2 101 187 | * | 1/1983 |
| GB | 2 192 660 A | * | 1/1988 |
| JP | 6-42165 | * | 2/1994 |

* cited by examiner

*Primary Examiner*—Carl D. Friedman
*Assistant Examiner*—Jennifer I. Thissell
(74) *Attorney, Agent, or Firm*—Richard C. Conover

(57) ABSTRACT

The fall arrester according to the present invention includes a plurality of upright standards which are spaced apart along the sill plate of a wall of a building under construction. The upright standards extend above the sill plate and netting is attached to the upright members to span the space between adjacent upright standards. A ledge bracket is provided on each of the upright standards which extends inwardly from the wall to which the upright standard is secured. Planks are then placed on the ledge brackets of adjacent upright standards to provide a working platform for workers installing roof trusses and sheathing. At the gable end of the building, a gable-end pole is mounted to a truss and lifelines are installed between the pole and the upright standards to prevent workers from falling from the gable-ends of the roof.

7 Claims, 11 Drawing Sheets

ROOFTOP FALL ARRESTER WITH WORKING PLATFORM

This application claims the benefit of provisional application Ser. No. 60/288,954, filed May 4, 2001.

BACKGROUND OF THE INVENTION

The present invention relates to a fall arrester with working platform for use at construction sites when installing roof trusses and/or roof sheathing placed on top the roof trusses.

When installing roof trusses or roof sheathing, workers are in danger of falling. Because of the roof elevation, falling can cause serious injury. Therefore, it is desirable to provide a fall arrester at the edge of the roof to catch and prevent a roofer from falling. Indeed, today, the Federal Safety Regulations issued by OSHA require every commercial, industrial and residential structure under construction to have some type of a fall arrester in place.

Various rooftop fall protection devices are known. See, for example, U.S. Pat. No. 5,558,312 to Brennan; U.S. Pat. No. 6,167,986 to Calvillo; and U.S. Pat. No. 6,345,689 to McNamee.

The present invention is an improvement over the known fall arresters and has several objectives:

A first objective is to provide a portable fall arrester which can be easily installed and easily removed.

A second objective is to provide a fall arrester which meets all OSHA requirements.

A third objective is to provide a fall arrester device that is easy and inexpensive to manufacture.

A fourth objective is to provide a fall arrester which includes netting to catch workers, which netting is positioned adjacent a roof edge and only a short distance above the top surface of the roof.

A fifth objective is to provide a working platform located inside the wall of the building under construction which can be used by workers when working on installing roof trusses and sheathing.

A sixth objective is to provide a fall arrester system which can be used at a gable-end of a building under construction.

SUMMARY OF INVENTION

The fall arrester according to the present invention includes a plurality of upright standards which are spaced apart along the sill plate of a wall of a building under construction. The upright standards extend above the sill plate and netting is attached to the upright members to span the space between adjacent upright standards. A ledge bracket is provided on each of the upright standards which extends inwardly from the wall to which the upright standard is secured. Planks are then placed on the ledge brackets of adjacent upright standards to provide a working platform for workers installing roof trusses and sheathing. At the gable end of the building, a gable-end pole is mounted to a truss and lifelines are installed between the pole and the upright standards to prevent workers from falling from the gable-ends of the roof.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
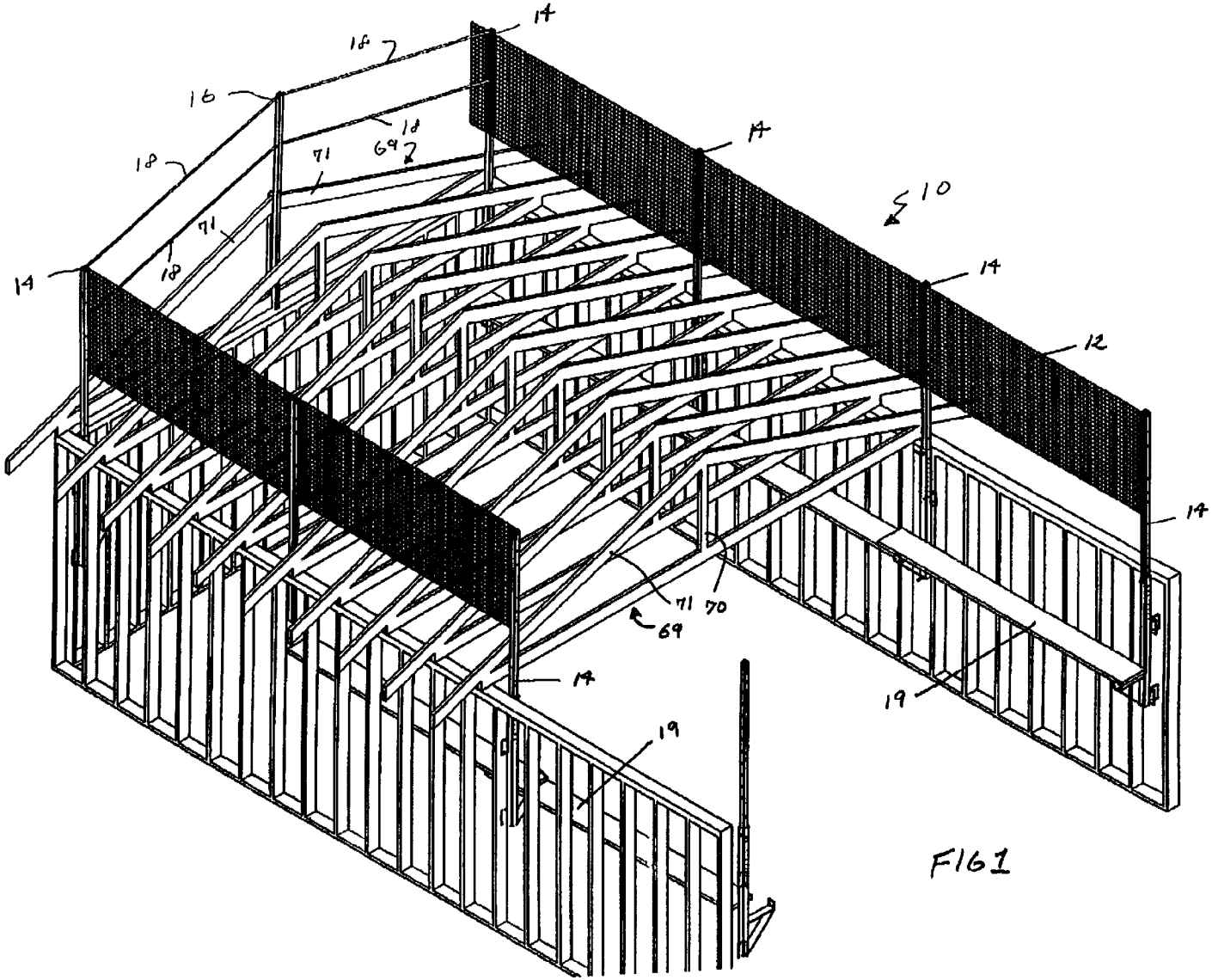
FIG. 1 is a perspective view of building under construction with a full arrester, according to the present invention, installed.

A rooftop fall arrester 10, according to the present invention, is shown in FIG. 1 installed on a building during construction. The present invention includes mesh netting 12 installed on a plurality of upright support standards 14. The upright standards 14 further support a plank platform 19, as shown in FIG. 1. At a gable end of the building being constructed, an upright gable-end pole 16 is installed. Upright gable-end pole 16 supports lifelines 18.

Figure 2:
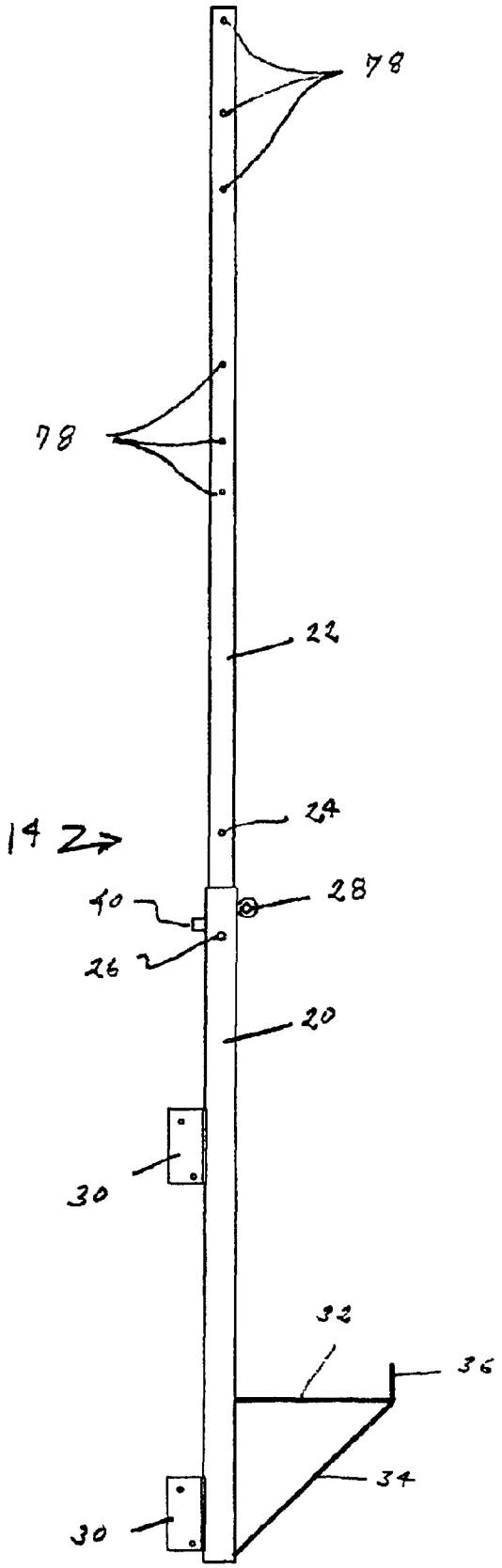
FIG. 2 is an elevational view of an upright standard used with the present invention.
Figure 3:
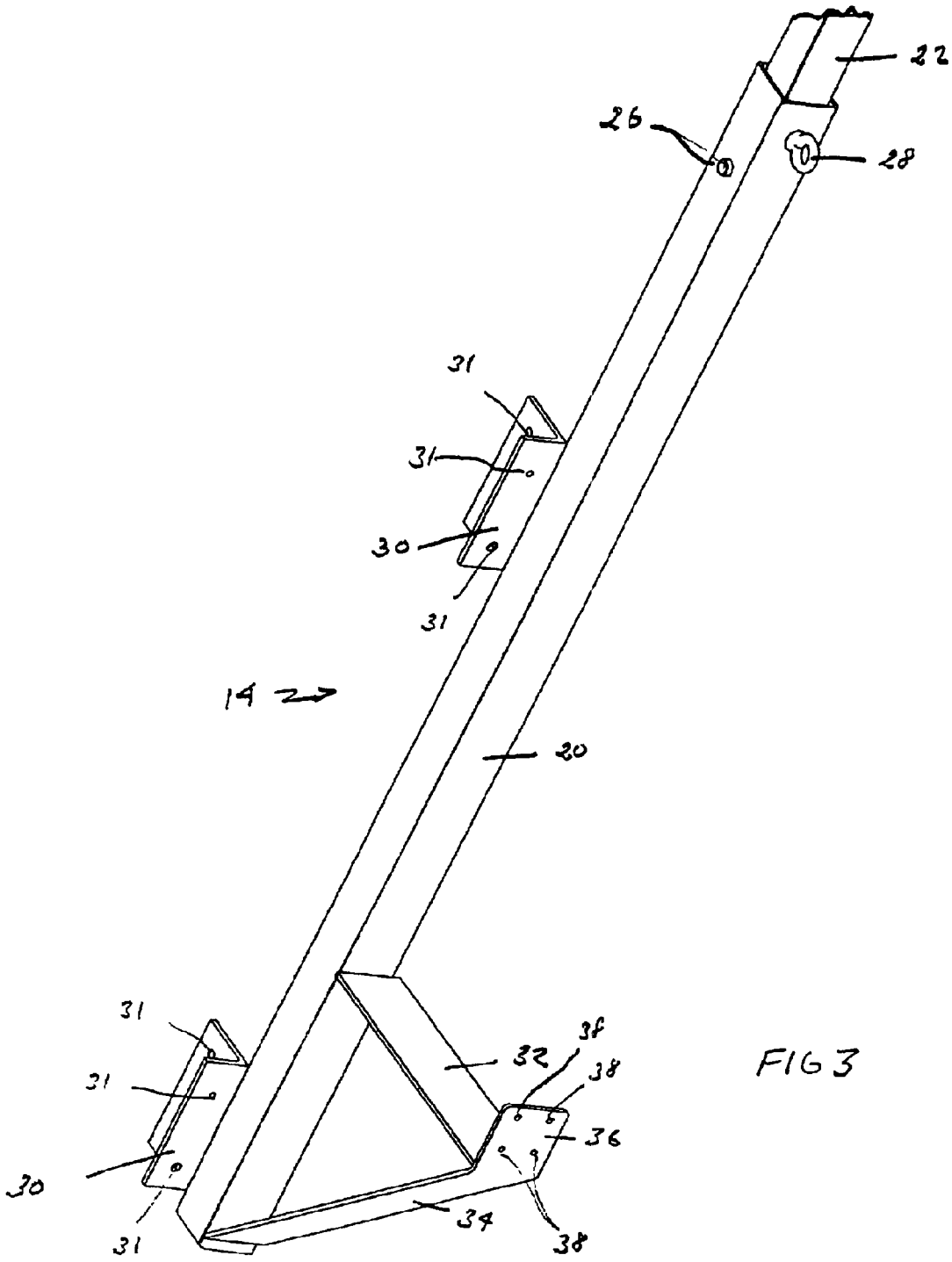
FIG. 3 is a perspective view of the upright standard shown in FIG. 2.

A support standard 14 is shown in FIGS. 2 and 3. The support standard 14 includes a tubular square channel section 20. A second tubular channel section 22 is sized to telescopically slide within the tubular channel 20.

Figure 4:
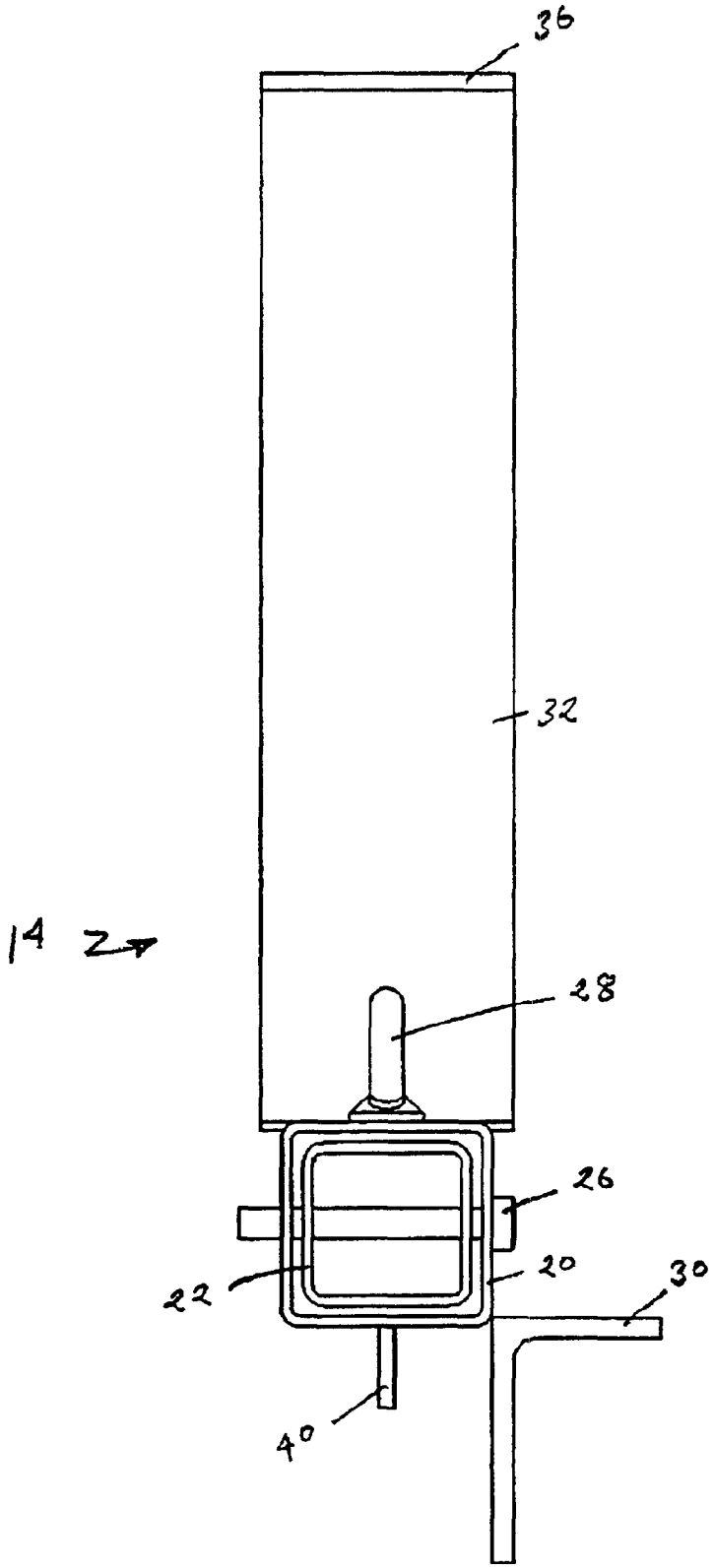
FIG. 4 is an enlarged top view of the upright standard shown in FIG. 2.

The second tubular channel 22 is provided with a series of height-adjusting pin holes 24 which extend entirely through the channel 22. The lower tubular channel 20 is provided with a pin receiving hole (not shown) which extends entirely through the channel 22, and is positioned so that it may be aligned with a selected hole 24 in channel 22. The pin receiving hole is provided with a pin 26, as shown in FIGS. 2–4, which when aligned with a hole 24 secures channel 22 to channel 20 with channel 22 extending a selected height above channel 20.

The tubular channel 20 is further provided with a lifeline eye anchor 28 through which a lifeline may be attached to secure a worker to a selected upright standard 14.

The tubular channel 20 is further provided with a pair of angle brackets 30 which are spaced apart along tubular channel 20, as shown. An exterior corner of each of the angle brackets 30 is secured as by welding to an outside corner of tubular channel 20, as shown in FIGS. 3 and 4. The angle brackets 30 include holes 31 for receiving lag nuts.

An elongate ledge plate 32 has one end welded to the channel 20, as shown in FIG. 3. Support bracing 34 includes an upturned end 36. The ledge plate 32 has a free end welded to the upturned end 36, as shown in FIG. 3. The support bracing 34 has one end welded to channel 20, as shown in FIG. 3. The upturned end 36 is provided with a series of holes 38 for receiving screws.

Figure 5:
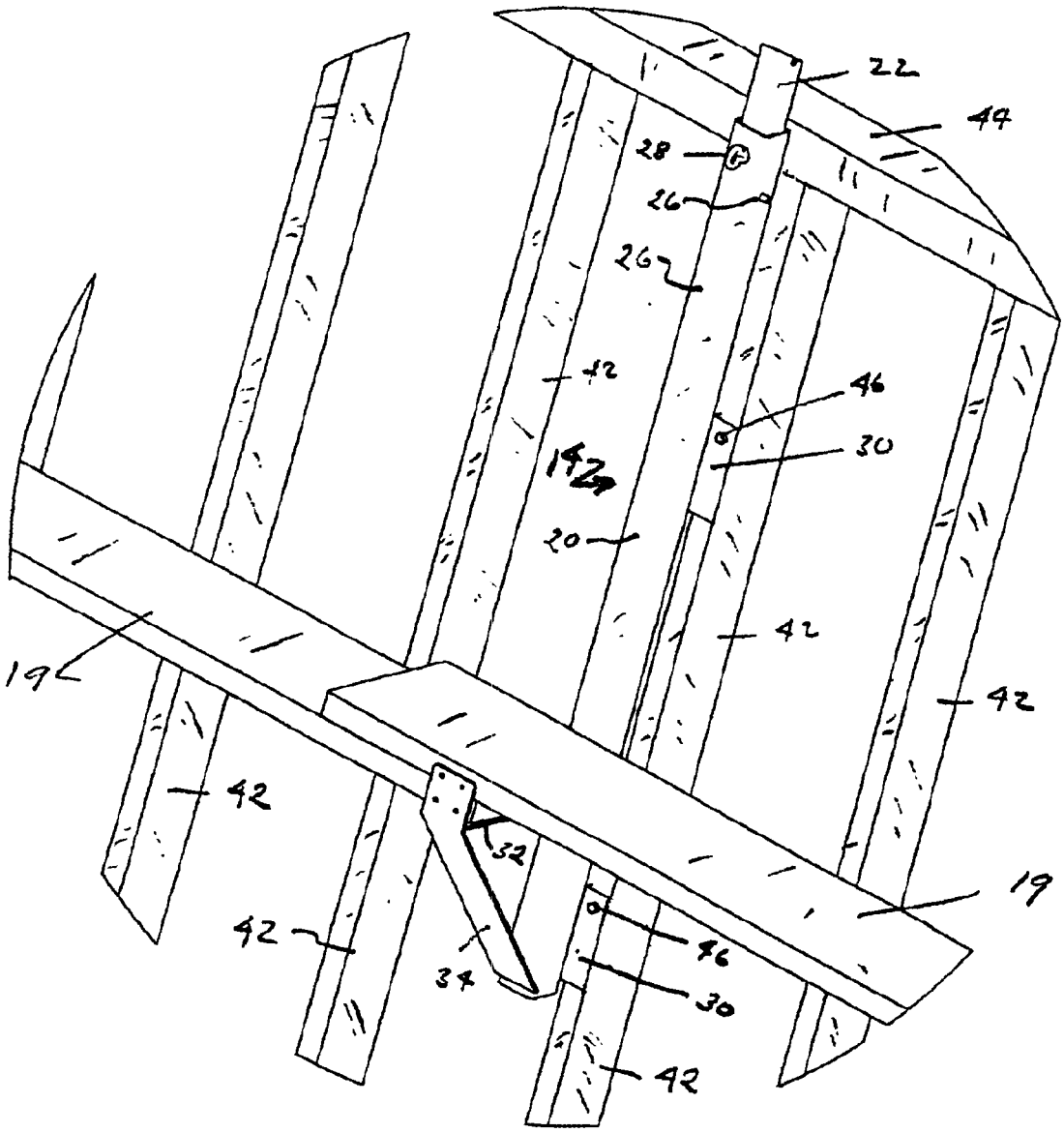
FIG. 5 is a detail perspective front view showing installation of an upright standard shown in FIG. 2 to a wall stud of the building under construction.
Figure 6:
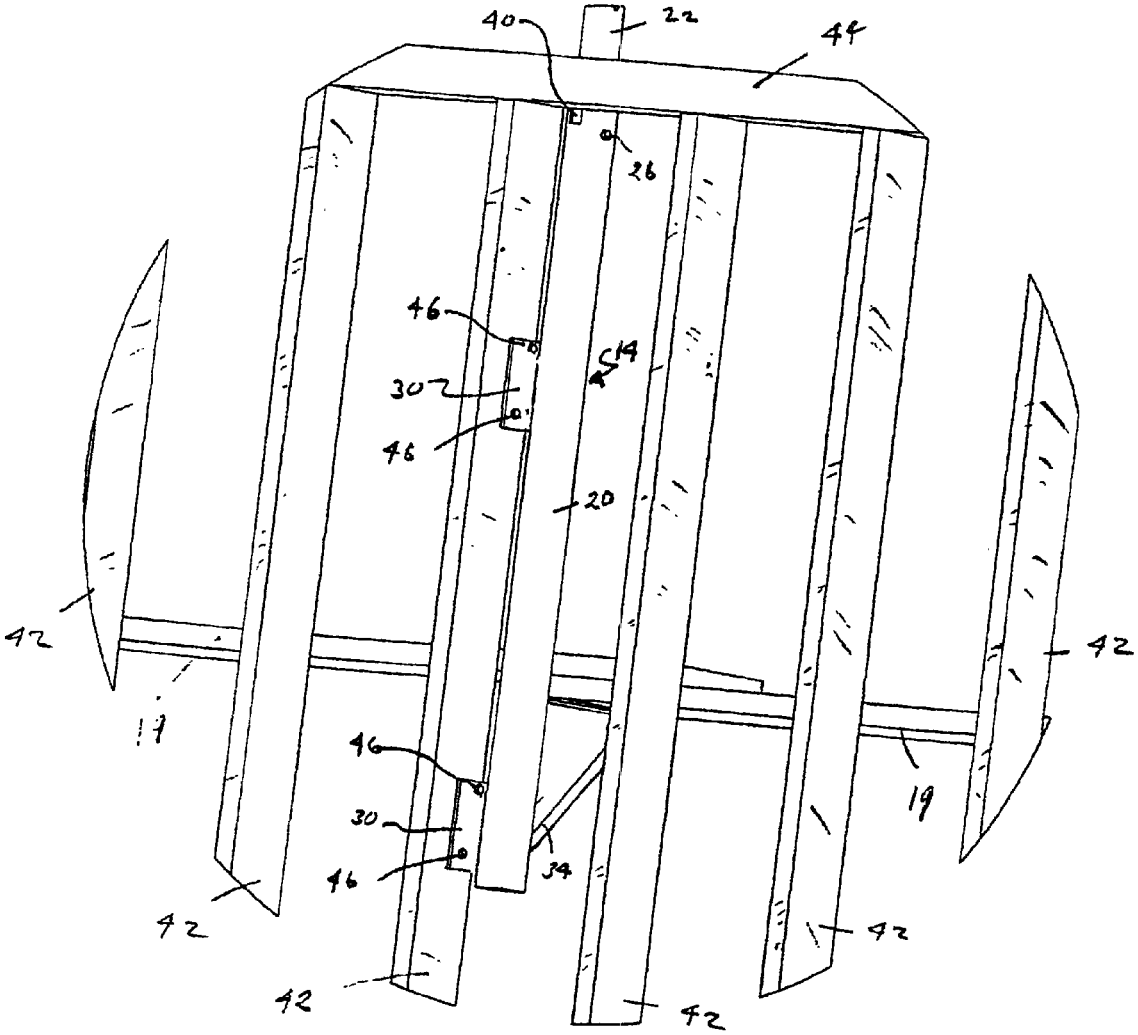
FIG. 6 is a detail perspective rear view of the upright standard shown in FIG. 5.

The channel 20 is further provided with an alignment boss 40 as shown in FIGS. 2 and 4. The upright support standard 14 is mounted to a wall stud 42 of a building under construction, as shown in FIGS. 5 and 6. The alignment boss 40 is first positioned adjacent the underside of a sill plate 44 of the building under construction, as shown in FIG. 6. Lag bolts 46 are then inserted through the holes 31 provided in the angle brackets 30 and screwed into a selected wall stud 42. Platform planks 19 are then laid on the ledge plates 32 of adjacent upright support standards 14, as shown in FIGS. 1, 5 and 6. Screws may be inserted through holes 38 of the upturned end 36 for securing the planking in place. The ledge plates 32 are located a distance below the sill plate 44 so that when a worker is standing on planks 19, the sill plate 44 functions as a rail to prevent the worker from falling outside the wall of the building under construction.

Figure 7:
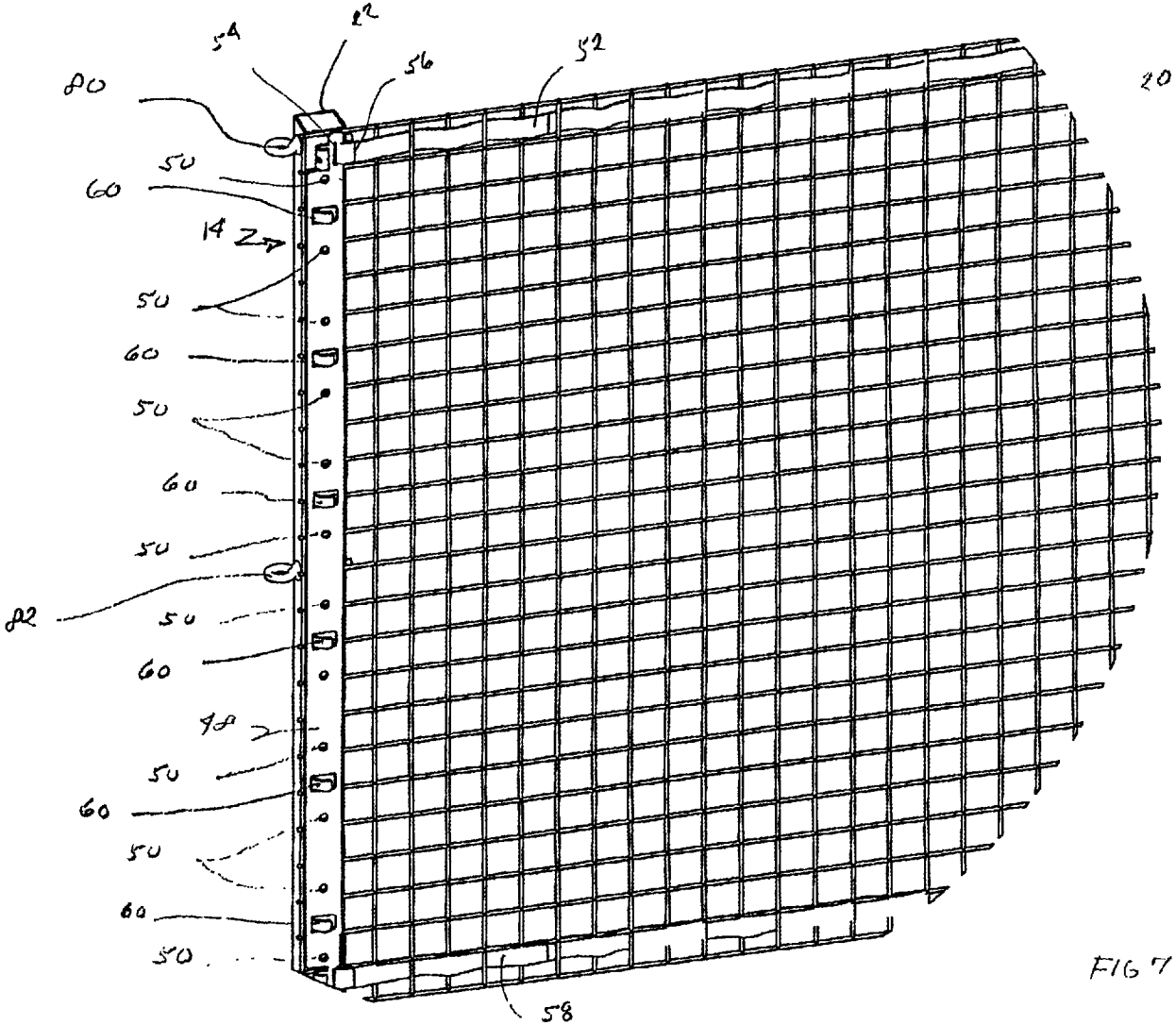
FIG. 7 is a partial perspective detail view of a net secured to an upright standard.
Figure 8:
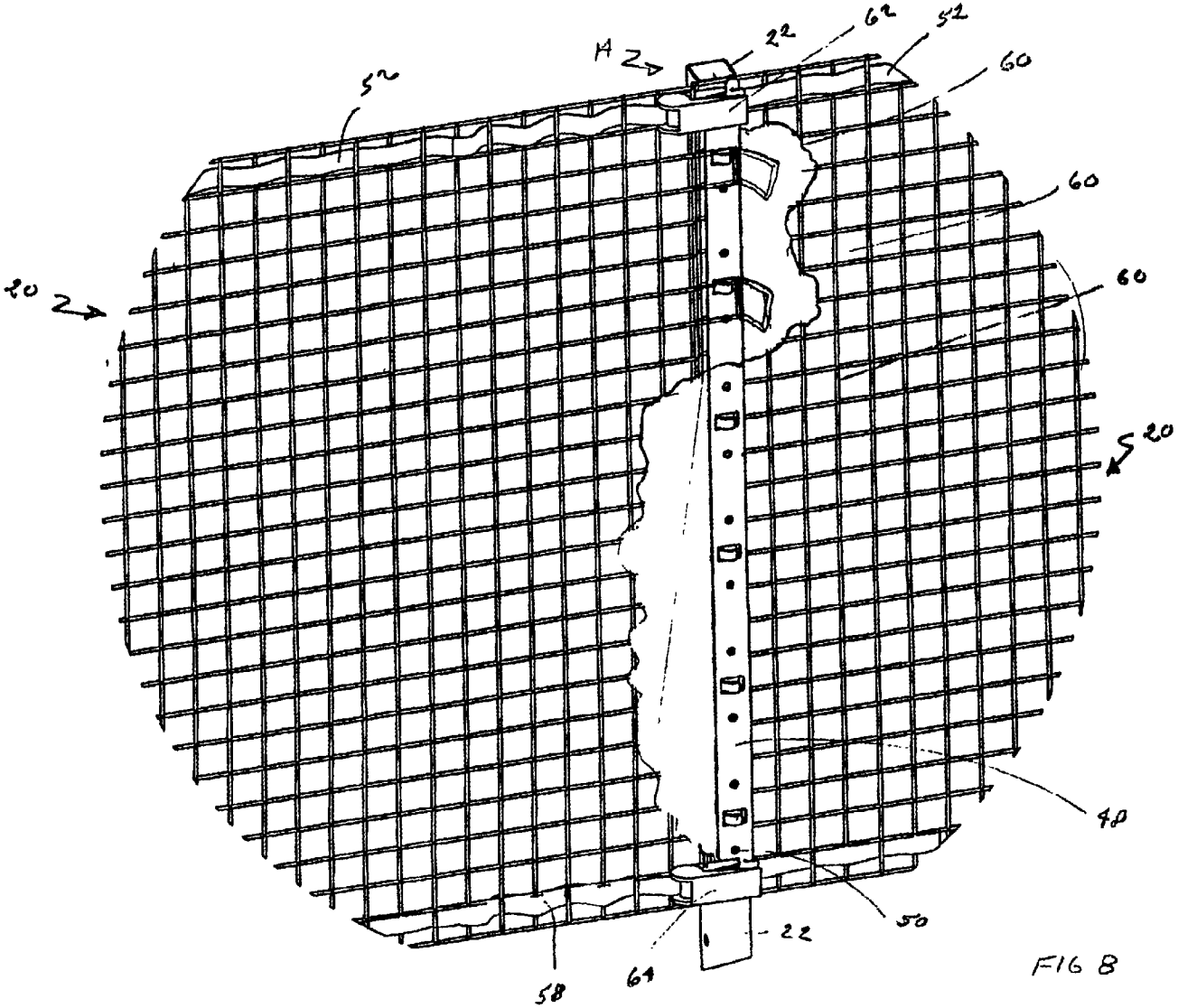
FIG. 8 is a partial perspective detail view of the net secured to a second upright standard with portions of the net removed.
Figure 9:
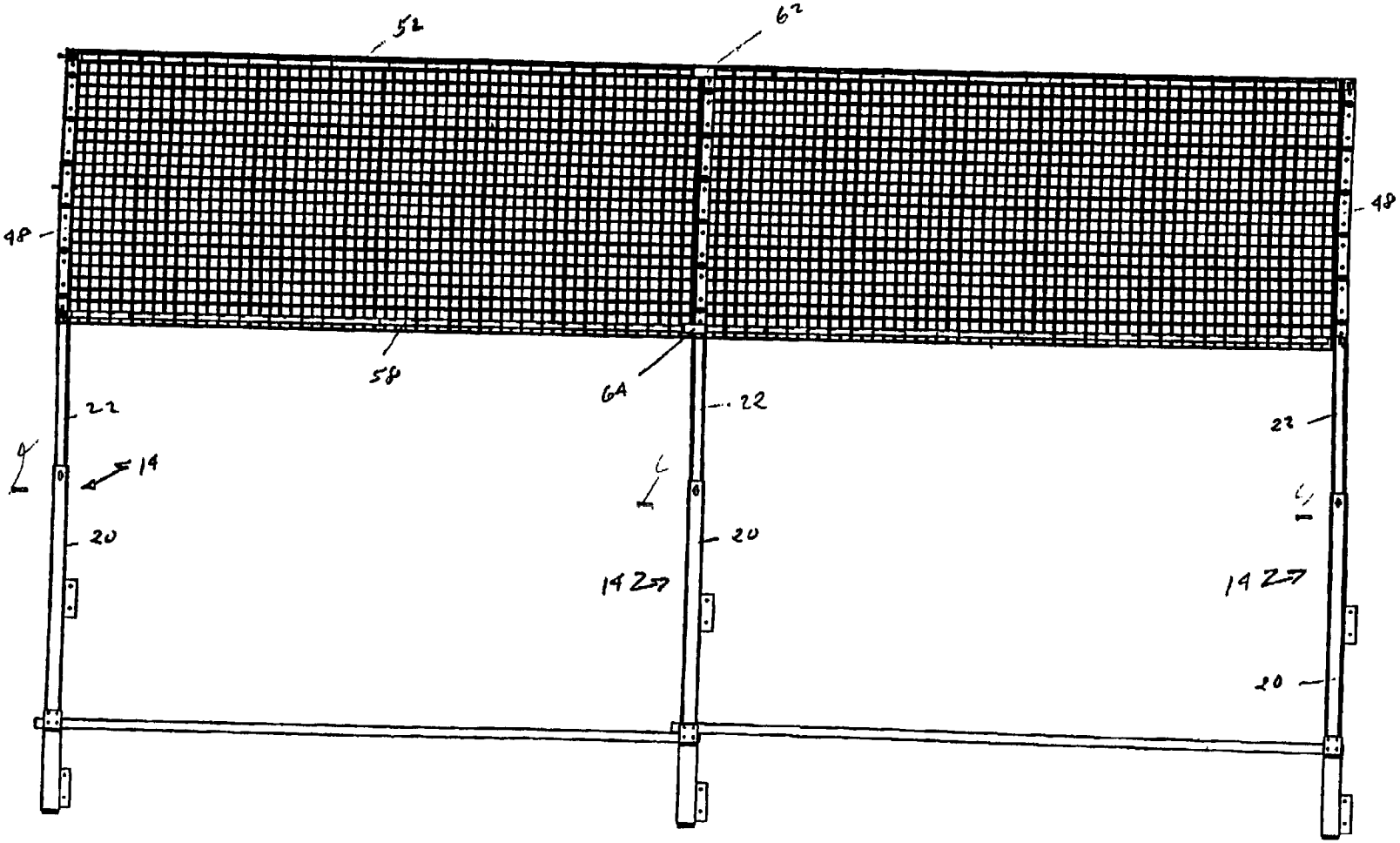
FIG. 9 is a front elevational view of the net attached to adjacent upright standards.

The netting 12 is attached to the upright support standards 14, as shown in FIGS. 7–9. In a preferred embodiment, the netting 12 is constructed of polypropylene material. When the mesh netting 12 is installed on upright support standards 14, the netting 12 is positioned only a short distance above the roof level to prevent workers from sliding underneath the netting.

As shown in FIG. 7, an elongate metallic plate 48 overlies a portion of the netting 12, and is secured to channel 20 of the upright support standard 14 with lag bolts 50. Further, a top nylon strap 52 is interwoven in the netting as shown in FIG. 7. An end of the strap 52 is inserted within a slot 54, provided in the plate 48, and then folded over on itself and sewn as at 56.

Similarly, a bottom nylon strap 58 is interwoven through the mesh of the netting 20, as shown in FIG. 7. An end of the nylon strap 58 is attached to the plate 48 in a manner similar to the top nylon strap 52.

In a preferred embodiment, the netting 20 has one edge secured to an upright support standard 14, as shown in FIG. 7, by being pinned between plate 48 and channel 22. The free end of the netting 20 is secured to an adjacent upright standard 14, as shown in FIG. 8. A ratchet latch 62 is removably attached to the upright standard 14, as shown in FIG. 8, in a conventional manner. A free end of the top nylon strap 52 is threaded through the ratchet 62. The ratchet 62 is then ratcheted to tighten the strap 52 between adjacent standards 14. Similarly, a lower ratchet latch 64 is removably mounted in a conventional manner to the standard 14, and is used to tighten the lower nylon strap 58.

The plate 48 is provided with a plurality of outwardly extending punched-out tabs 60. The free end of the netting 20 is then stretched to be caught by the tabs 60, as shown in FIG. 8.

In installing the netting at a job site, the upright standards 14 are first secured to wall studs 42 of the building under construction with lag bolts 46, as shown in FIGS. 1, 5 and 6. Each standard has a portion of the netting 20 secured to each upright support standard 14, as shown in FIG. 7. Next, the free ends of the top and bottom nylon straps 52 and 58 are inserted in the upper and lower ratchet latches 62 and 64, respectively, and the ratchets used to tighten the nylon straps between the adjacent upright standards 14. Next, the tabs 60 are used to catch the netting which has been stretched between the upright standards 14. This is started at one end of the netting 20 being installed, as shown in FIGS. 1 and 9, and is continued until all of the netting is installed for the particular building site. Planking 19 is placed on the ledge plates 32 of adjacent upright standards 14, as shown in FIGS. 1, 5 and 6, to provide a walking surface for persons installing roof trusses or roof sheeting. With this construction, the netting provides a fall arrester which meets all of the OSHA and ANSI standards.

Figure 10:
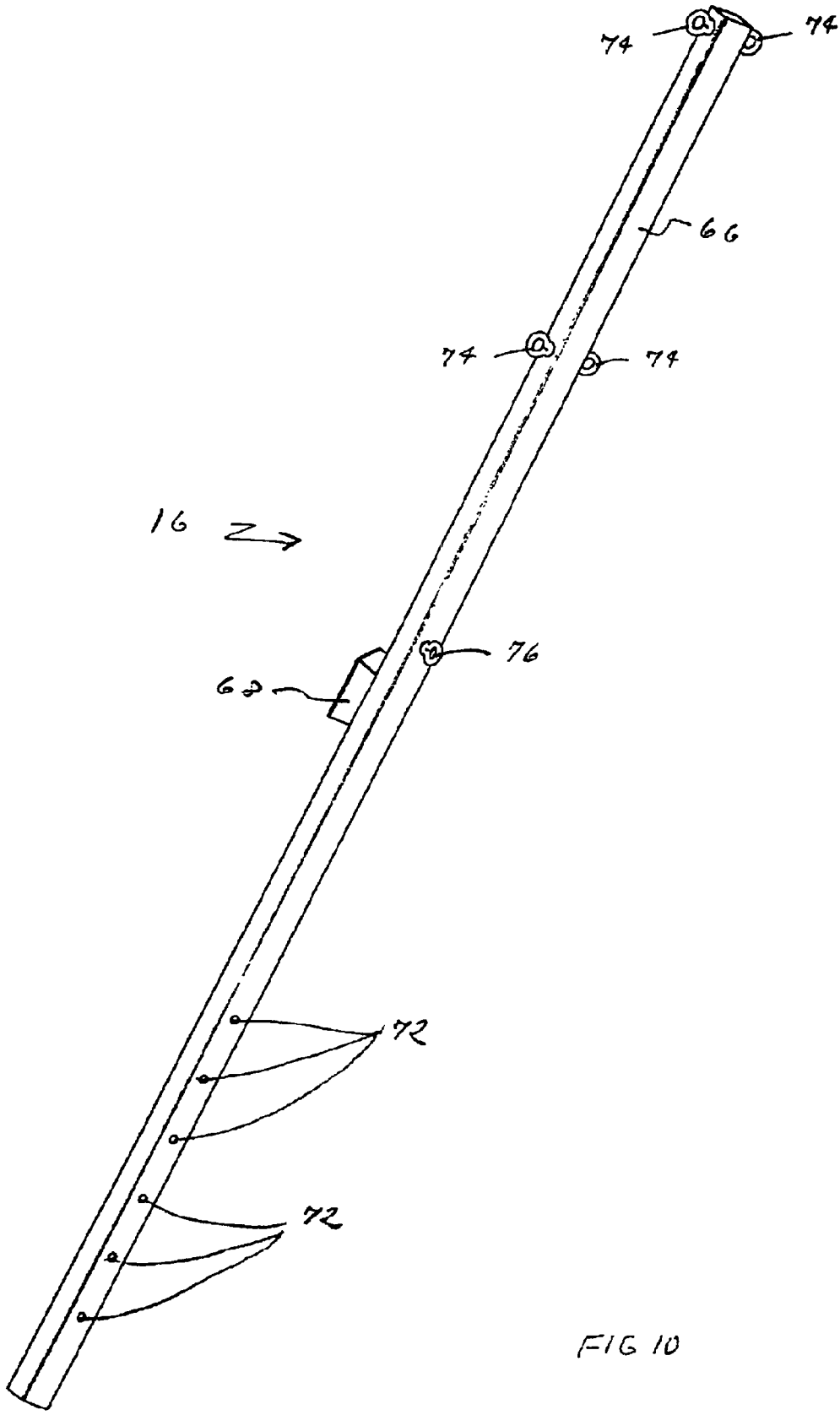
FIG. 10 is a rear perspective view of a gable end upright standard according to the present invention.
Figure 11:
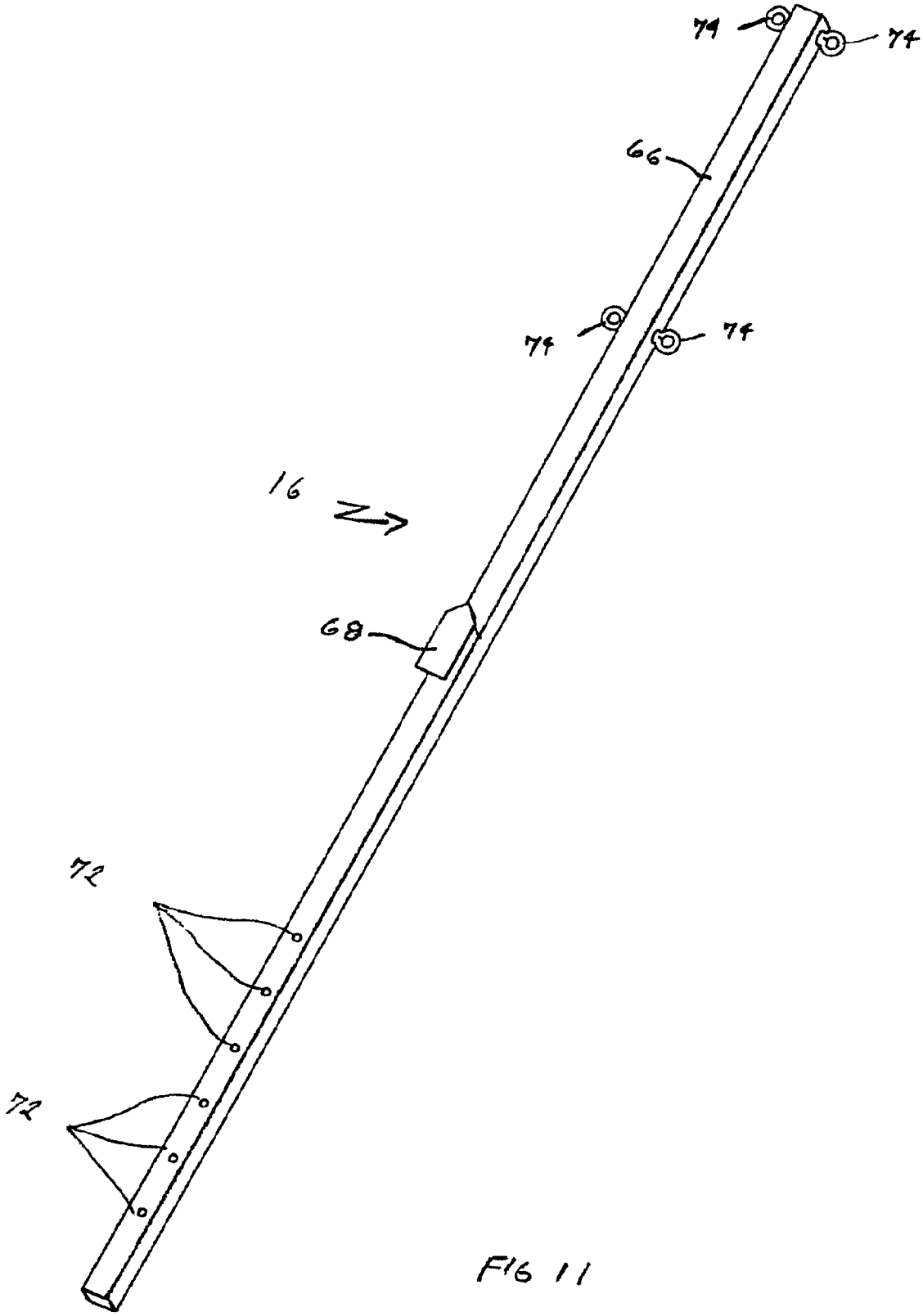
FIG. 11 is a front perspective view of the upright standard shown in FIG. 10.

At the gable ends of the building site, another upright gable-end pole 16 is used for supporting lifelines 18. This upright gable-end pole 16 is shown in FIGS. 10 and 11.

The upright gable-end pole 16 is constructed of a one-piece square channel member 66. An alignment block 68 is welded to the channel member 66, as shown in FIGS. 10 and 11. The alignment block 68 is used for properly positioning the gable-end pole 16 relative to a truss 69, as shown in FIG. 1. Each of the trusses 69 have an upright bracing member 70 extending to the apex of the truss formed by the intersection of two upper chord members 71. The alignment block 68 has a shaped upper portion for fitting in the angular space provided between the bracing member 70 and the roof joist of the truss 69. Further, the channel 66 is provided with a plurality of holes 72 for receiving lag bolts (not shown). The lag bolts are used to secure the upright gable-end pole 16 to the upright bracing member 70 of the truss 69.

Four eye bolts 74 are attached to the channel member 66 to which the anchor lines 18 are tied. An additional eye bolt 76 is provided to which a lifeline attached to a workman working on the roof can be secured, as shown in FIG. 10.

Each of the upright standards 14, as shown in FIG. 2, have a plurality of holes 78 extending through the channel member 22. An eye bolt 80, as shown in FIG. 7, is inserted through one of the holes in the upper series of holes 78, as shown in FIG. 2, and a nut threadably secured to the threaded end of bolt 80 to secure the eye bolt 80 to the upright standard 14. A second eye bolt 82 is inserted through one of the lower series of holes 78, as shown in FIG. 2, and a nut used to secure the eye bolt 82 to the upright standard 14, as shown in FIG. 7.

To secure the lifelines 18 to the upright standard 14 and gable-end pole 16, as shown in FIG. 1, the lifeline 18 has one end tied to an eyelet 74 of upright gable-end pole 16 and has its other end tied to the eyelet 80 of upright standard 14. A second lifeline has one end tied to an eyelet 74 of upright gable-end pole 16 and a second end tied to an eye bolt 82 provided on upright standard 14. As shown in FIG. 1, four lifelines 18 are secured between standard 14 and gable-end pole 16 in this manner.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims.

I claim:

1. A rooftop fall arrester in combination with a wall having upright wall studs and a sill plate capping the wall studs of a wood frame building having an inside and outside comprising:

a plurality of upright standards having a first lower portion and a second upper portion;

attachment means for securing the first portions of the upright standards in spaced apart relation along the sill plate to extend upwardly on an inside surface thereof with the second portions extending above the sill plate;

mesh netting;

means for attaching the netting to the second portions of the upright standards with the netting spanning the space between adjacent upright standards above the sill plate and in close proximity to the sill plate;

a strap interwoven through the mesh netting and further including means for attaching one end of the strap to one upright standard and a ratchet latch mounted on an adjacent upright standard for receiving a free end of the strap for tightening the strap between adjacent upright standards;

a ledge bracket attached to the first portion adjacent a lower end thereof and extending inwardly from the wall; and a plank resting on the ledge bracket of adjacent upright standards.

2. The fall arrester according to claim 1 wherein the second portion of the upright standard is constructed of tubular material, and wherein the first portion is constructed of tubular material and sized to slidably receive the second tubular portion and further including means for securing the second portion to the first portion at a selected position.

3. The fall arrester according to claim 1 wherein the ledge bracket has an upturned end for preventing a plank from sliding off the ledge bracket.

4. The fall arrester according to claim 1 wherein the attachment means includes a pair of angle brackets shaped to abut an exterior surface of a wall stud and lag bolts for securing the angle brackets to the wall stud.

5. The fall arrester according to claim 1 wherein the upright standard further includes an alignment boss means mounted to the first portion of the upright standard for abutting the underside of the sill plate to properly position the first portion of the upright standard with respect to the sill plate in an upward direction.

6. The fall arrester according to claim 1 wherein the first portion of the upright standard is further provided with an eye bolt secured to the first portion for receiving a lifeline attached to a worker.

7. The fall arrester according to claim 1 further including a gable-end fall arrester in combination with a gable end of the wood frame building having a roof truss with an apex, an upper cord and an upright bracing member extending to the apex comprising:

an upright gable-end pole mounted to the upright bracing and having an upper portion extending above the apex of the roof truss;

an alignment block mounted to the gable-end pole for abutting the upper cord beneath the apex to properly position the height of the upper portion above the apex;

an eye bolt secured to the upper portion;

the upright standard further including an eye bolt secured to the second portion of the upright standard; and a lifeline extending between the eye bolt of the gable-end pole and the eye bolt of the upright standard and secured thereto.

* * * * *